US009708802B2

(12) United States Patent
Gibson

(10) Patent No.: US 9,708,802 B2
(45) **Date of Patent: *Jul. 18, 2017**

(54) UNDERMOUNT SINK

(71) Applicant: Rod Gibson, Gig Harbor, WA (US)

(72) Inventor: Rod Gibson, Gig Harbor, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/844,935

(22) Filed: Sep. 3, 2015

(65) Prior Publication Data

US 2016/0222636 A1 Aug. 4, 2016

Related U.S. Application Data

(63) Continuation of application No. 13/299,237, filed on Nov. 17, 2011, now Pat. No. 9,157,219.

(60) Provisional application No. 61/415,189, filed on Nov. 18, 2010.

(51) Int. Cl.

| | |
|---|---|
| ***E03C 1/33*** | (2006.01) |
| ***E03C 1/05*** | (2006.01) |
| ***E03C 1/048*** | (2006.01) |
| ***E03C 1/18*** | (2006.01) |
| ***E03C 1/044*** | (2006.01) |
| *E03C 1/04* | (2006.01) |

(52) U.S. Cl.

CPC ..... *E03C 1/057* (2013.01); *E03C 1/044* (2013.01); *E03C 1/048* (2013.01); *E03C 1/055* (2013.01); *E03C 1/18* (2013.01); *E03C 1/33* (2013.01); *E03C 2001/0414* (2013.01)

(58) Field of Classification Search

CPC ..... E03C 1/33

USPC ..... 4/619–660; 108/20, 50.11; 29/401.1

See application file for complete search history.

(56) References Cited

U.S. PATENT DOCUMENTS

| | | | |
|---|---|---|---|
| 3,829,911 | A | 8/1974 | Bishop |
| 4,771,488 | A | 9/1988 | Markham |
| 5,025,516 | A | 6/1991 | Wilson |
| 5,115,974 | A | 5/1992 | Tobias et al. |
| 5,127,111 | A | 7/1992 | Sieth |
| 5,309,581 | A | 5/1994 | Lockwood et al. |
| 5,388,285 | A | 2/1995 | Belniak |

(Continued)

FOREIGN PATENT DOCUMENTS

| | | | |
|---|---|---|---|
| DE | 10 2004 040082 | A1 | 2/2006 |
| EP | 1 593 782 | A2 | 11/2005 |

(Continued)

*Primary Examiner* — Lori Baker

(74) *Attorney, Agent, or Firm* — Seed IP Law Group LLP

(57) ABSTRACT

An undermount sink system is provided for mounting beneath a countertop having an upper counter surface. The undermount sink system includes a sink basin and a discharge conduit coupled to the sink basin, which is positioned to expel fluid into the sink basin via an outlet thereof. The discharge conduit and basin are configured to mount to the countertop entirely below the upper counter surface. The flow of fluid through the discharge conduit may be activated via a motion sensor or switch coupled directly to the basin or a spacer ring positioned between the basin and the countertop. Controls for adjusting the temperature and/or flow rate of fluid through the discharge conduit may also be coupled to the basin or a spacer ring positioned between the basin and the countertop, or alternatively, to a surface of the countertop. Methods of making and using undermount sink systems are also provided.

14 Claims, 9 Drawing Sheets

(56) References Cited

U.S. PATENT DOCUMENTS

| | | | | |
|---|---|---|---|---|
| 5,819,335 | A | 10/1998 | Hennessy | |
| 5,860,172 | A * | 1/1999 | Pfeiffer | E03C 1/33 312/228 |
| 5,915,851 | A * | 6/1999 | Wattrick | A47B 77/022 4/619 |
| 6,016,579 | A | 1/2000 | Erbs | |
| 6,044,854 | A | 4/2000 | Marks | |
| 8,794,577 | B2 | 8/2014 | Laera | |
| 2004/0194208 | A1 | 10/2004 | Milne | |
| 2006/0048295 | A1 | 3/2006 | Aldrich | |
| 2007/0061960 | A1 | 3/2007 | Sha et al. | |
| 2008/0115266 | A1 | 5/2008 | Loberger et al. | |
| 2009/0056011 | A1* | 3/2009 | Wolf | E03C 1/057 4/623 |
| 2009/0173388 | A1 | 7/2009 | Sever | |
| 2010/0011499 | A1 | 1/2010 | Schiller | |
| 2010/0276518 | A1 | 11/2010 | Kajuch | |
| 2011/0191954 | A1 | 8/2011 | Fajerstein | |
| 2011/0271441 | A1 | 11/2011 | Bayley et al. | |

FOREIGN PATENT DOCUMENTS

| | | | |
|---|---|---|---|
| EP | 2 164 010 | A1 | 1/2010 |
| FR | 2 685 619 | A1 | 7/1993 |
| GB | 2 464 869 | A | 5/2010 |
| WO | 2006/018273 | A1 | 2/2006 |
| WO | 2009/022112 | A1 | 2/2009 |

* cited by examiner

UNDERMOUNT SINK

CROSS-REFERENCE TO RELATED APPLICATIONS

This application is a continuation of U.S. patent application Ser. No. 13/299,237, filed Nov. 17, 2011, which claims the benefit under 35 U.S.C. §119(e) of U.S. Provisional Patent Application No. 61/415,189, filed Nov. 18, 2010, the entire disclosure of which is herein incorporated by reference for all purposes.

BACKGROUND

Technical Field

This disclosure generally relates to sinks, and more particularly to undermount sinks with enhanced functionality.

Description of the Related Art

A conventional undermount sink 10 is illustrated in FIG. 1, which shows a basin 12 mounted directly to the underside of a countertop 14 such that no portion of the basin 12 extends to the upper surface of the countertop 14. A conventional faucet 16 with controls for turning on the faucet 16 and adjusting water temperature is also shown mounted to the countertop 14 in a position to discharge water into the basin 12 in a generally downward direction. This type of sink arrangement provides a substantially flat working surface in the area immediately adjacent the sink and eliminates a sink interface that would otherwise be present on the surface of the countertop 14 where food particles or other debris can collect. The presence of the faucet 16 on the surface of the countertop 14, however, can create various shortcomings. For example, the interface between the faucet 16 and the countertop 14 provides areas where debris and grime may collect. The faucet 16 can also serve as an obstruction to various culinary activities. Still further, manipulating the controls of the faucet 12 can lead to unsanitary conditions around the sink 10.

BRIEF SUMMARY

The undermount sinks and methods of making and using the same described herein provide for sink arrangements that are particularly well suited for domestic and commercial applications in which cleanliness and unobstructed counter space is of particular concern. In addition, the various sink arrangements provide enhanced user functionality. In various embodiments, the undermount sinks are mountable to the underside of a countertop or similar structure with all devices for controlling the flow and temperature of water located below the countertop surface. In other embodiments, one or more devices for controlling the flow and/or temperature of the water may be located on an upper surface of the countertop or in other locations remote from the sink basin.

At least one embodiment of an undermount sink system for mounting beneath a countertop having an upper counter surface may be summarized as including a basin, the basin having a drain hole at a lower end thereof; and a discharge conduit coupled to the basin and positioned to expel fluid into the basin via an outlet of the discharge conduit when a flow of fluid through the discharge conduit is activated, the discharge conduit and basin configured to mount to the countertop entirely below the upper counter surface. The discharge conduit may be positioned to expel fluid in an initial direction generally parallel to the upper counter surface when the undermount sink is mounted to the countertop. The basin and discharge conduit may be integrally formed.

The undermount sink system may further include a supplemental discharge conduit coupled to the basin and positioned to expel fluid into the basin via a supplemental outlet of the supplemental discharge conduit when a flow of fluid through the supplemental discharge conduit is activated. The discharge conduit may be positioned to expel fluid into the basin in an initial direction that is generally perpendicular to an initial direction with which fluid is expelled from the supplemental discharge conduit during operation thereof.

The undermount sink system may further include a spacer ring coupleable to an upper end of the basin to space the basin from the countertop when the basin is installed for use. The spacer ring may be configured to receive the discharge conduit and couple the discharge conduit to the basin. The spacer ring may house a plurality of lighting elements to enable selective illumination of an interior cavity of the basin. The undermount sink system may further include at least one motion sensor communicatively coupled to the plurality of lighting elements to illuminate the interior cavity of the basin when motion is sensed in a room containing the undermount sink system. The spacer ring may house a plurality of position sensors, the position sensors arranged to sense a position of a hand when the hand is positioned within an interior cavity of the basin. The undermount sink system may further include a control unit communicatively coupled to the plurality of position sensors to receive a position signal therefrom and regulate the flow of fluid through the discharge conduit during operation based at least in part on said position signal. The control unit may be communicatively coupled to the plurality of position sensors to receive a position signal therefrom and regulate a temperature of the flow of fluid through the discharge conduit during operation based at least in part on said position signal.

The undermount sink system may further include a heater unit coupled to the discharge conduit via a fluid supply line, the heater unit operable to elevate the temperature of the flow of fluid through the discharge conduit near boiling when the flow of fluid is initially activated. At least one motion sensor may be communicatively coupled to the heater unit to activate the heater unit to enable the heater unit to supply the flow of fluid through the discharge conduit near boiling when motion is sensed in a room containing the undermount sink system.

The undermount sink system may further include a rotating head coupled to the outlet of the discharge conduit, the rotating head including a plurality of apertures having different configurations to enable selective variation of at least one of a shape and a direction of a stream of fluid expelled from the discharge conduit during operation.

The undermount sink system may further include a sensor coupled to the basin to sense movement of a user and activate the flow of fluid through the discharge conduit based on said movement. A plurality of position sensors may be coupled to the basin to sense a hand position and regulate the flow of fluid through the discharge conduit based on said hand position.

The undermount sink system may further include a valve coupled to the discharge conduit, the valve operable to control at least one of a rate and a temperature of the flow of fluid through the discharge conduit. The valve may be operable via a control device coupled directly to the wall of the basin. The valve may be operable via a control display device positioned remotely from the basin, the control display device including controls operable to control at least one of a rate and a temperature of the flow of fluid through the discharge conduit.

A wireless communication device may be operatively coupled to the valve to enable remote control of the valve via a handheld device. The undermount sink system may include a switch to selectively activate and deactivate the flow of fluid through the discharge conduit, the switch coupled to the wall of the basin. A thermostat may be operatively coupled to the discharge conduit to detect and regulate a temperature of the flow of fluid therethrough.

At least one embodiment of a sink system configured for installation on the underside of a countertop may be summarized as including a sink basin; a discharge conduit coupled to the sink basin and positioned to expel fluid into the sink basin via an outlet of the discharge conduit below an upper surface of the countertop when a flow of fluid through the discharge conduit is activated; a valve coupled to the discharge conduit, the valve operable to control at least one of a rate and a temperature of the flow of fluid through the discharge conduit; and a control device communicatively coupled to the valve to selectively adjust the valve in response to one or more control signals generated by an interaction of a user with the sink system within an interior region of the sink basin.

A sensor may be coupled to the sink basin to sense a movement of the user within the interior region of the sink basin and generate a control signal based on said movement. A sensor may be coupled to the sink basin to sense a position of a hand of the user within the interior region of the sink basin and generate a control signal based on said position. The sink system may further include a switch to selectively activate and deactivate the flow of fluid through the discharge conduit, the switch coupled directly to the sink basin. The sink system may further include a spacer ring coupleable to an upper end of the sink basin to space the sink basin from the countertop when the sink basin is mounted to the countertop, the spacer ring configured to receive the discharge conduit.

At least one embodiment of a sink basin mounting system for coupling a sink basin beneath a countertop may be summarized as including a spacer ring coupleable to the sink basin to space the sink basin from the countertop when the sink basin is mounted thereto; and a discharge conduit provided at least partially within the spacer ring below the upper counter surface and positioned to expel fluid into the basin via an outlet of the discharge conduit when the spacer ring is coupled to the sink basin and a flow of fluid through the discharge conduit is activated. A plurality of lighting elements may be provided within the spacer ring to enable selective illumination of an interior cavity of the sink basin. The sink basin mounting system may further include a plurality of position sensors provided within the spacer ring, the position sensors arranged to sense a position of an object when the object is positioned within an interior cavity of the sink basin.

At least one embodiment of a method of sink operation may be summarized as including sensing a position of an object within an interior region of a basin of a sink; and discharging fluid through a discharge conduit which is coupled to the basin of the sink entirely below an upper surface of a countertop to which the sink is installed. The method may further include adjusting at least one of a rate and a temperature of the flow of fluid through the discharge conduit in response to the position of the object. Adjusting at least one of the rate and the temperature of the flow of fluid through the discharge conduit in response to the position of the object may include increasing the rate of the flow of fluid in accordance with increasing distance of the object from a sidewall of the basin. Adjusting at least one of the rate and the temperature of the flow of fluid through the discharge conduit in response to the position of the object may include adjusting the temperature of the flow of fluid in accordance with the position of a hand within the interior region of the basin. Sensing the position of the object within the interior region of the basin of the sink may include sensing the position of a hand using a plurality of position sensors positioned around a perimeter of the sink. The method may further include illuminating the interior region of the basin with a plurality of light elements positioned around a perimeter of the sink. The method may further include discharging fluid through a supplemental discharge conduit which is coupled to the basin of the sink entirely below the upper surface of the countertop to which the sink is installed.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles may not be drawn to scale, and some of these elements may be arbitrarily enlarged and positioned to improve drawing legibility.

DETAILED DESCRIPTION

Figure 1:
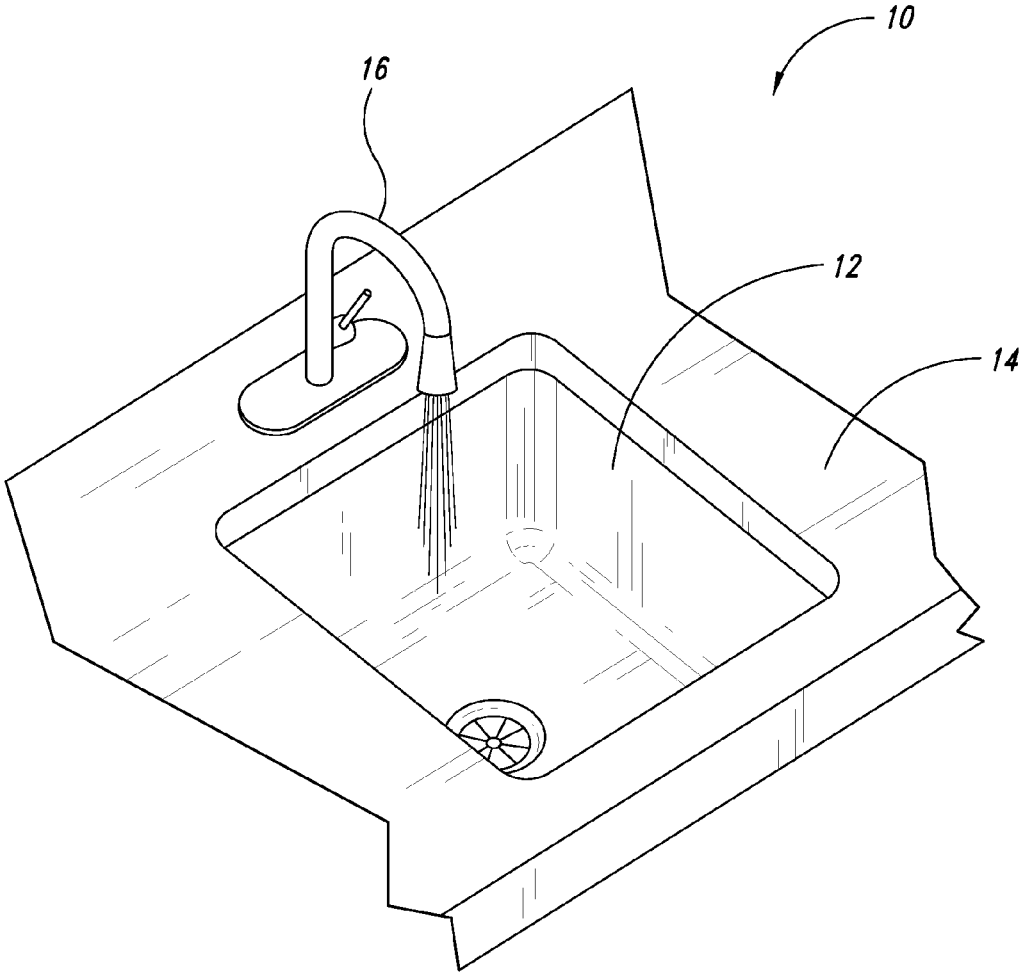
FIG. 1 (Prior Art)
FIG. 1 is an isometric view of a conventional undermount sink and faucet.
Figure 2:
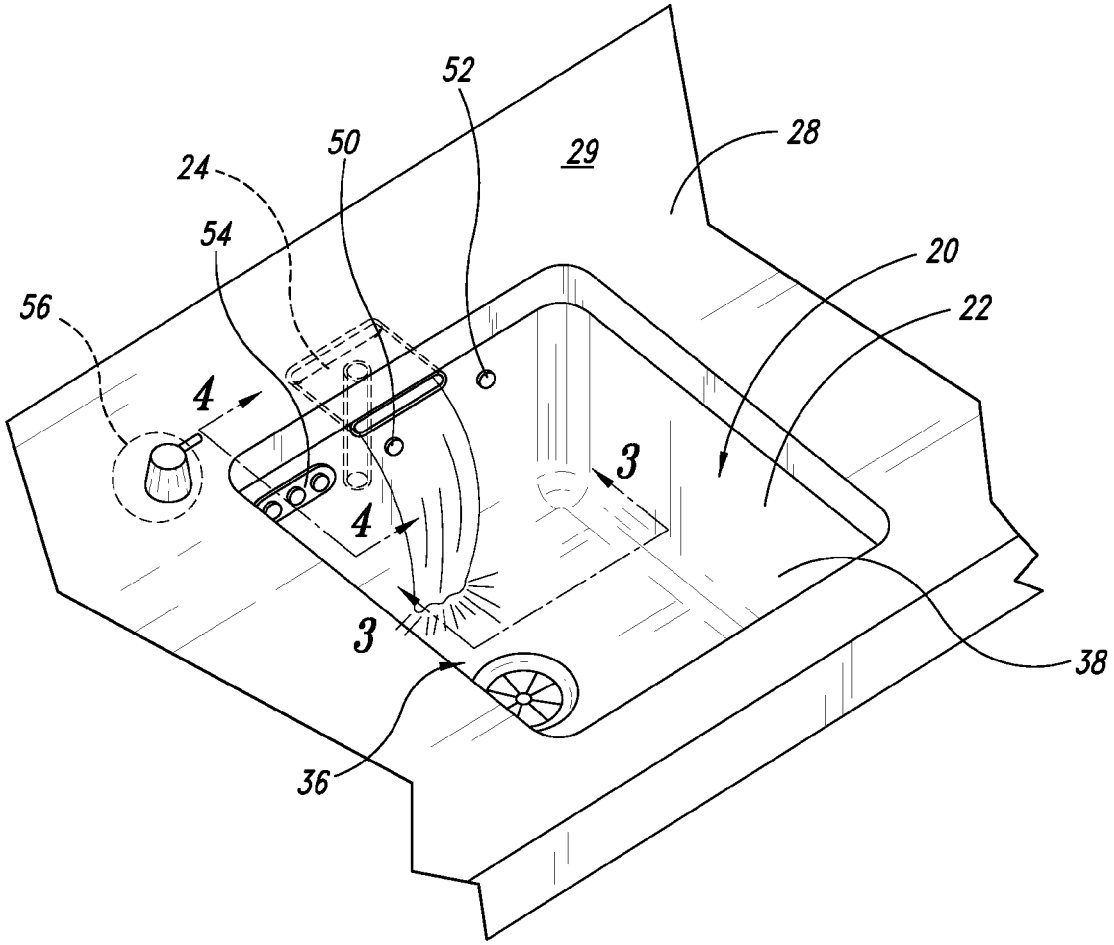
FIG. 2 is an isometric view of an undermount sink system according to one embodiment.
Figure 3:
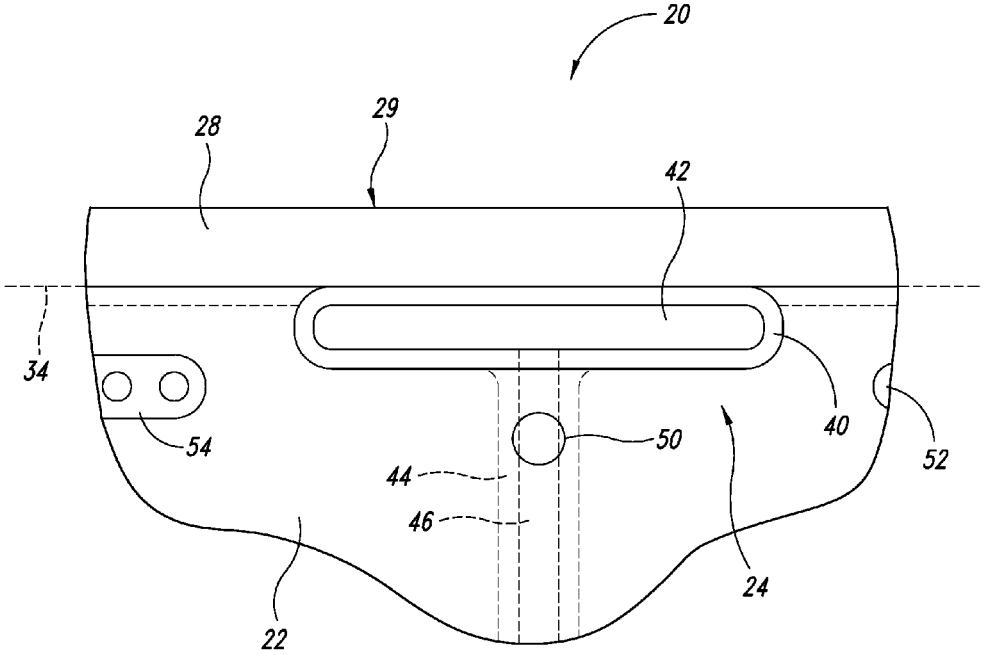
FIG. 3 is a partial detail view of the undermount sink system of FIG. 2 taken along the line 3-3.
Figure 4:
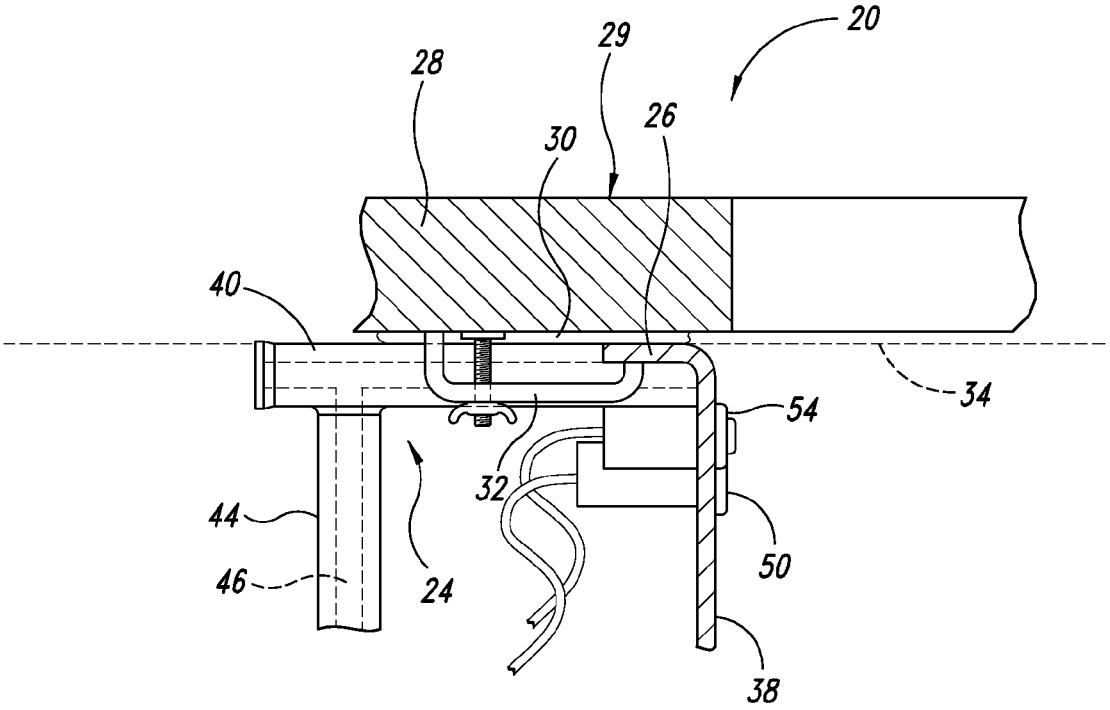
FIG. 4 is a partial cross-sectional view of the undermount sink system of FIG. 2 taken along line 4-4.
Figure 5:
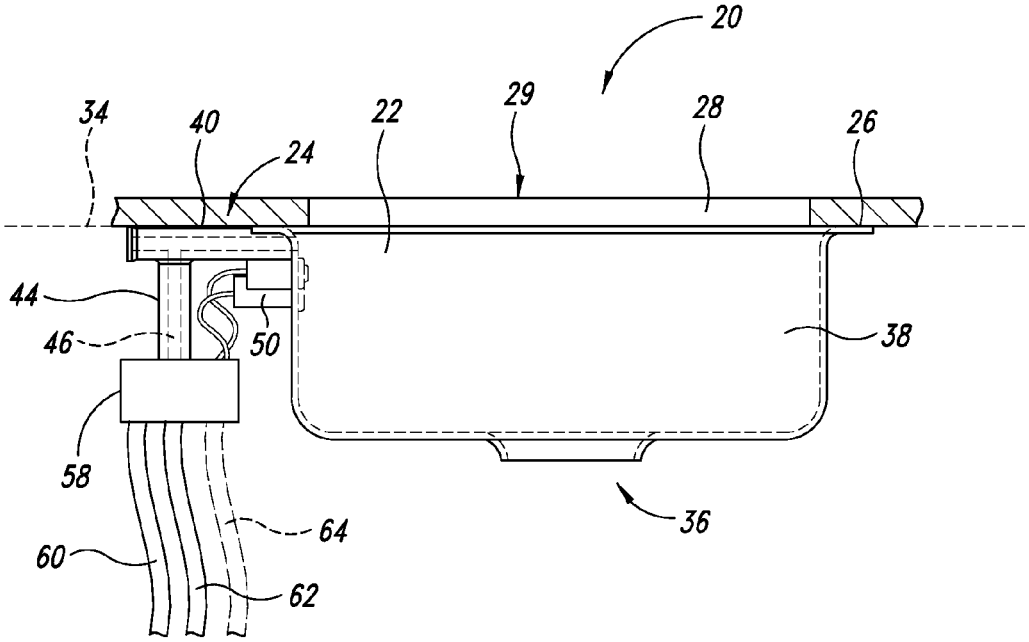
FIG. 5 is a side elevational view of the undermount sink system of FIG. 2.

In the following description, certain specific details are set forth in order to provide a thorough understanding of various disclosed embodiments. However, one skilled in the relevant art will recognize that embodiments may be practiced without one or more of these specific details. In other instances, well-known structures and manufacturing techniques associated with domestic and commercial sinks and faucets as well as methods of making and installing the same may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

FIGS. 2 through 5 show an undermount sink system 20 according one embodiment. The undermount sink system 20 includes a sink basin 22 defining a water receptacle. A discharge conduit 24 is coupled to the sink basin 22 to discharge water into the sink basin 22 when the sink system 20 is installed and in operation. The sink basin 22 includes a flange 26 at an upper end thereof for mounting the sink basin 22 to the underside of a countertop 28 or like structure. The flange 26 extends at least partially around the upper perimeter of the sink basin 22 and, in some embodiments, entirely around the upper perimeter. Adhesive 30 and mounting hardware 32 may used to secure the flange 26 of the sink basin 22 to the countertop 28 or like structure. In this manner, the flange 26 defines a substantially horizontal mounting plane 34 for interfacing with the countertop 28 or like structure.

A drain hole 36 is located in a lower end of the sink basin 22 for connecting the sink system 20 to a suitable drainage or sewer system. The shape of the sink basin 22 is defined by basin walls 38 that collectively span between the drain hole 36 and the flange 26. The general shape of the sink basin 22 may be generally rectangular, as shown in the illustrated embodiment of FIGS. 2 through 5, or any other shape including bowl-shaped and irregularly shaped sink basins. Consequently, the walls 38 or portions thereof may be flat, concave or convex or combinations thereof. Although the walls 38 of the illustrated embodiment are shown as a number of distinct intersecting walls, it is appreciated that the sink basin 22 may have a single continuous wall structure, such as a concave bowl structure.

As previously described, a discharge conduit 24 is coupled to the sink basin 22 to discharge water into the sink basin 22 when the sink system 20 is installed and in operation. As shown in FIGS. 2 through 5, the discharge conduit 24 may be coupled to the sink basin 22 at an upper end thereof such that an upper surface of the discharge conduit 24 is substantially flush with the mounting plane 34 defined by the flange 26. As such, the discharge conduit 24 may also be secured to the countertop 28 or like structure with adhesive and/or mounting hardware when installing the sink system 20.

The discharge conduit 24 is shown in the illustrated embodiment as an elongated tubular structure 40 having a generally rectangular cross-sectional profile, although it is appreciated that the cross-sectional profile of the tubular structure 40 can be any regular or irregular shape. Alternatively, the discharge conduit 24 may comprise a passageway extending through a non-tubular structure.

According to the illustrated embodiment in which the cross-sectional profile of the discharge conduit 24 is generally rectangular, water may be expelled from an outlet 42 of the discharge conduit 24 in a cascading waterfall that projects toward a central portion of the sink basin 22. In some embodiments, a ratio of a width of the cross-sectional profile of the outlet to a height of the cross-sectional profile of the outlet is equal to or greater than 5:1. In such embodiments, the water expelled from the outlet 42 may be suitably formed to travel a sufficient distance from the wall 38 of the sink basin 22 to facilitate washing one's hands, dishes or performing other activities.

A supply tube 44 is shown connected to the elongated tubular structure 40 of the discharge conduit 24 in a substantially perpendicular arrangement. The supply tube 44 includes a central cavity 46 to enable a flow of water to enter the elongated tubular structure 40 for subsequent discharge into the sink basin 22. In some embodiments, the supply tube 44 may be welded, fused or otherwise permanently affixed to the elongated tubular structure 40. Alternatively, the supply tube 44 may be removably coupled to the elongated tubular structure 40, such as, for example, by threaded connections. Similarly, in some embodiments, the discharge conduit 24 may be welded, fused or otherwise permanently affixed to the wall 38 of the sink basin 22, or alternatively, removably coupled to the sink basin 22. In still further embodiments, the discharge conduit 24 and the sink basin 22 may be integrally formed. For example, the discharge conduit 24 and the sink basin 22 may be formed as a unitary porcelain component.

Although the discharge conduit 24 of the illustrated embodiment is shown in a generally flush arrangement with the flange 26 of the sink basin 22, it is appreciated that the discharge conduit 24 may be positioned in other positions offset from the flange 26. In addition, although the discharge conduit 24 is shown in a generally horizontal orientation, it is appreciated that in some embodiments the discharge conduit may be oriented in different directions, such as, for example, at a declined angle relative to the horizontal mounting plane 34. Also, in some embodiments, a second discharge conduit (not shown) may be provided to operate in unison with or independent of the other discharge conduit 24. For example, two discharged conduits 24 may be provided on opposing or adjacent walls 38 of the sink basin 22.

With continued reference to FIGS. 2 through 5, the sink system 20 of the illustrated embodiment further includes a sensor 50 mounted to the wall 38 of the sink basin 22 proximate the outlet 42 of the discharge conduit 24. The sensor 50 may be a proximity or motion sensor. The sensor 50 is positioned to sense the presence of a user's hand or an object placed in front of the discharge conduit 24 and to activate the flow of water through the discharge conduit 24 in response thereto. In operation, the water may continue to flow until the presence of the user's hand or the object is no longer sensed by the sensor 50 or for a determined period of time or a combination thereof. For example, in one embodiment, water may continue to flow for a few seconds after the presence of the user's hand or the object is no longer sensed.

A control 52, such as a touch screen, push button or rocker switch, may also be mounted to the wall 38 of the sink basin 22 for enabling a user to selectively activate and deactivate the flow of water through the discharge conduit 24. The control 52 may take priority over the sensor 50, thereby enabling the flow of water into the sink basin 22 when an object or movement of the same is not present, and conversely, disabling the flow of water into the sink basin 22 when the object or motion of the same is present.

Further controls 54, either manual or electronic, may be provided for adjusting a temperature and/or flow rate of the water through the discharge conduit 24, as well as for providing other functionality described herein. For example, a touch screen may be provided with selectable temperature controls and/or selectable flow rate controls. In one embodiment, the controls 54 may be in the form of a touch screen having a small surface area that is inconspicuously positioned for convenient access by a user near the outlet 42. In some embodiments, various buttons, levers, switches and/or touch controls may be included that provide optional features such as, for example, discharging a specific volume of fluid. For instance, a user may operate a push button or touch screen control for discharging one liter of fluid through the discharge conduit 24. In such an embodiment, a volumetric flow sensor (not shown) may be coupled to the discharge conduit 24 for that purpose. Although the controls 54 are illustrated as being positioned within the sink basin 22, it is appreciated that the controls 54 may alternatively be located on an upper surface 29 of the countertop 28. For example, an optional control lever or dial 56 may be coupled to the upper surface 29 of the countertop 28 to adjust the temperature and/or flow rate of water moving through the discharge conduit 24. Further, in some embodiments, the sensor 50 and other controls 52, 54 may be located remote from the sink system 20 or remote from the area immediately around the sink, such as, for example, on a backsplash or other remote structure.

The sink system 20 may further include a control system 58 (FIG. 5) for routing water to the discharge conduit 24 during operation and dynamically regulating a temperature of the same. The control system 58 can include one or more valves (not shown) for selectively metering various amounts of hot and cold water from hot and cold water supply lines 60, 62. The control system 28 may also be equipped with a heat sensor (not shown) that can relay temperature information pertaining to the flow of water to allow the control system 58 to regulate the valves, thereby giving the user the ability to adjust the temperature of the water with a thermostat, for example.

Additionally, the control system 58 can be coupled to an optional instant hot water supply line 64 which is in fluid communication with a heater unit (not shown) for supplying nearly boiling hot water from the heater unit on demand. In this manner, the heater may selectively heat water to various temperatures during initial start up of the water flow to have the water temperature at a desired setting immediately, without delay. This instant hot water may be supplied temporarily until hot water from the separate hot water supply line 60 reaches the valve controls of the control system 58 and takes over or supplements the water supplied by instant hot water supply line 64. In other words, the control system 58 may interrupt the use of the instant hot water supply line 64 allowing the domestic water source of the hot water supply line 60 to maintain the desired temperature after the initial startup period. The controls 54 may also include a separate control or controls in communication with the control system 58 to operate a supply of the instant hot water supply line 64 independent of the main hot and cold water supply lines 60, 62.

In some embodiments, the various controls and sensors (e.g., motion sensor 50) described above may be coupled to the sink system 20 and connected to the control system 58 prior to installation of the sink system 20 in an assembled package such that the assembled package may be transported to an installation location and installed with relatively modest effort (e.g., the connection of water supply lines and drain pipes). These various controls and sensors interoperate to control the temperature and flow rate of the water through the discharge conduit 24, as well as provide other functionality described herein, such as by either manually or electronically controlling the one or more valves of the control system 58. In this manner, operation of the sink system 20 may be performed completely from within an interior region of the sink basin 22. In such embodiments, the upper surface 29 of the counter 28 may be completely barren in the immediate proximity of the sink system 20.

Further, in one embodiment, the control system 58 may also be remotely controlled using wireless communication devices, such as, for example, wireless Bluetooth technology. In this manner, the rate and/or temperature of flow discharged from the discharge conduit 24 may be selectively controlled by a user via a handheld electronic device, such as a cell phone, thereby providing further operational versatility.

Figure 6:
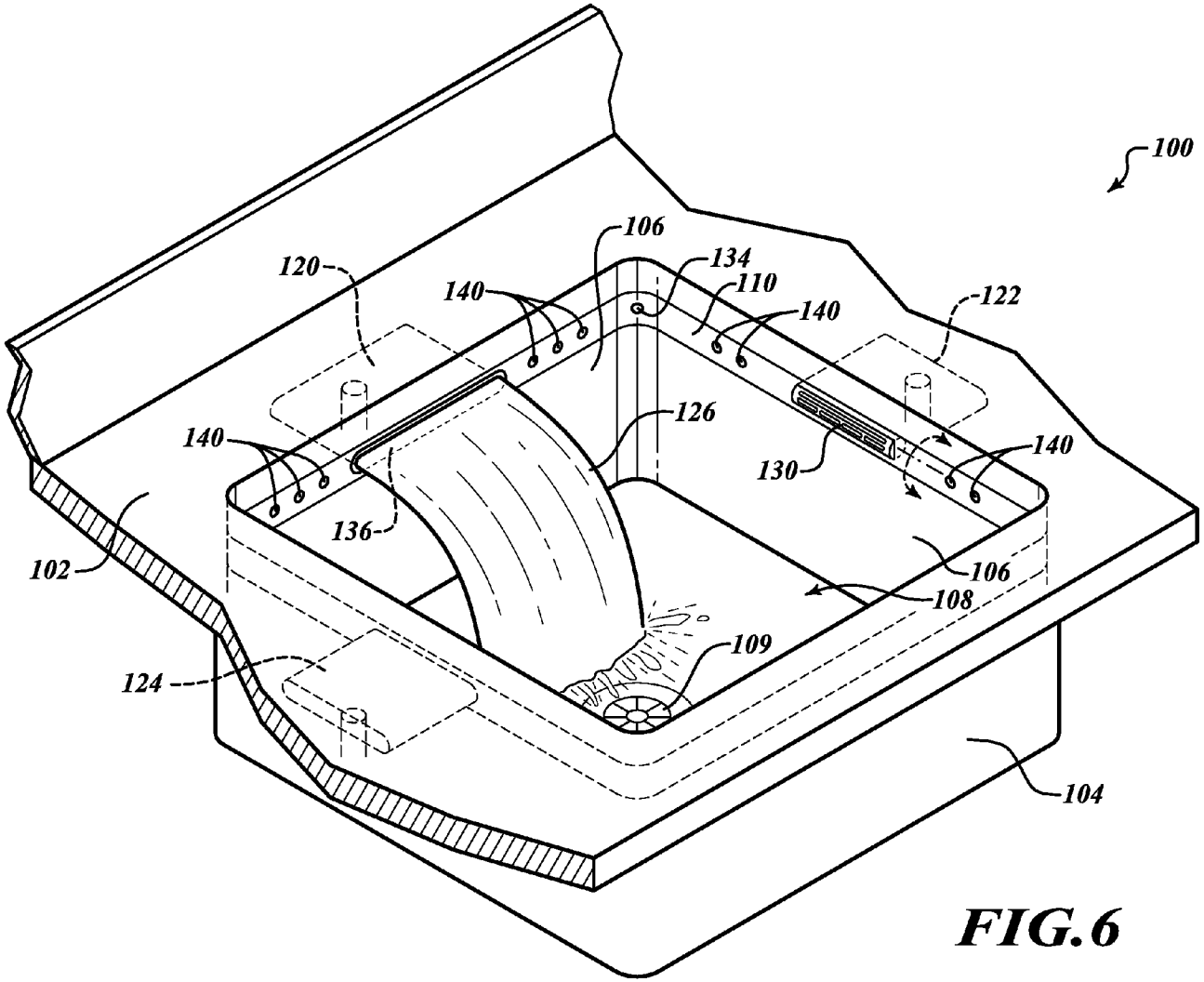
FIG. 6 is an isometric view of an undermount sink system according to another embodiment.

FIG. 6 illustrates a sink system 100 that is mountable to the underside of a countertop 102 or like structure, according to another example embodiment. The sink system 100 includes a sink basin 104 having a drain 109 and sidewalls 106 that define an internal region or cavity 108 of the sink basin 104. A mounting flange (not visible) is provided at an upper end of the sink basin 104 for mounting the sink basin 104 beneath the countertop 102 or like structure. The mounting flange may extend at least partially around the upper perimeter of the sink basin 104 and, in some embodiments, entirely around the upper perimeter. A spacer ring 110 may be provided and positioned intermediate the sink basin 104 and the countertop 102 to which the sink system 100 is installed. The spacer ring 110 may be sized and shaped to interface with the mounting flange of the sink basin 104 and may be secured to the same with adhesive and/or mounting hardware. Similarly, the spacer ring 110 may be secured with adhesive and/or mounting hardware to the countertop 102. The spacer ring 110 spaces the sink basin 104 below the countertop 102 and provides a structure for mounting various devices described in further detail below.

For example, the spacer ring 110 may include one or more apertures for receiving one or more respective discharge conduits 120, 122, 124 therein. More particularly, as shown in the example embodiment of FIG. 6, a primary discharge conduit 120 may be received within an aperture of the spacer ring 110 at one side or area of the sink basin 104 and one or more supplemental discharge conduits 122, 124 may be received within corresponding apertures of the spacer ring 110 located at other sides or areas of the sink basin 104. The discharge conduits 120, 122, 124 may be of different sizes and configurations to generate streams 126 of different shapes, trajectories and/or velocities. In addition, one or more of the discharge conduits 120, 122, 124 may include an adjustable head 130 for selectively adjusting a configuration of the stream of water flowing therefrom. For instance, an adjustable head 130 having a rotating portion with a plurality of selectable discharge apertures may be positioned at the outlet of one or more of the discharge conduits 120, 122, 124. The adjustable head 130 may be rotated manually or automatically in conjunction with a servomotor and an associated control system to generate different streams 126. For instance, the adjustable head may rotate between one discharge aperture for generating a generally flat stream in one position and another discharge aperture for generating a downwardly directed coarse spray in another position, which may be more suitable for cleaning dishes or other activities. An arching flow configuration may be provided in yet another position for filling taller pots or for simulating a drinking fountain. Irrespective of the shape and trajectory of the stream 126, the discharge conduits 120, 122, 124 are controlled to selectively discharge water into the basin 104 during operation.

Figure 7:
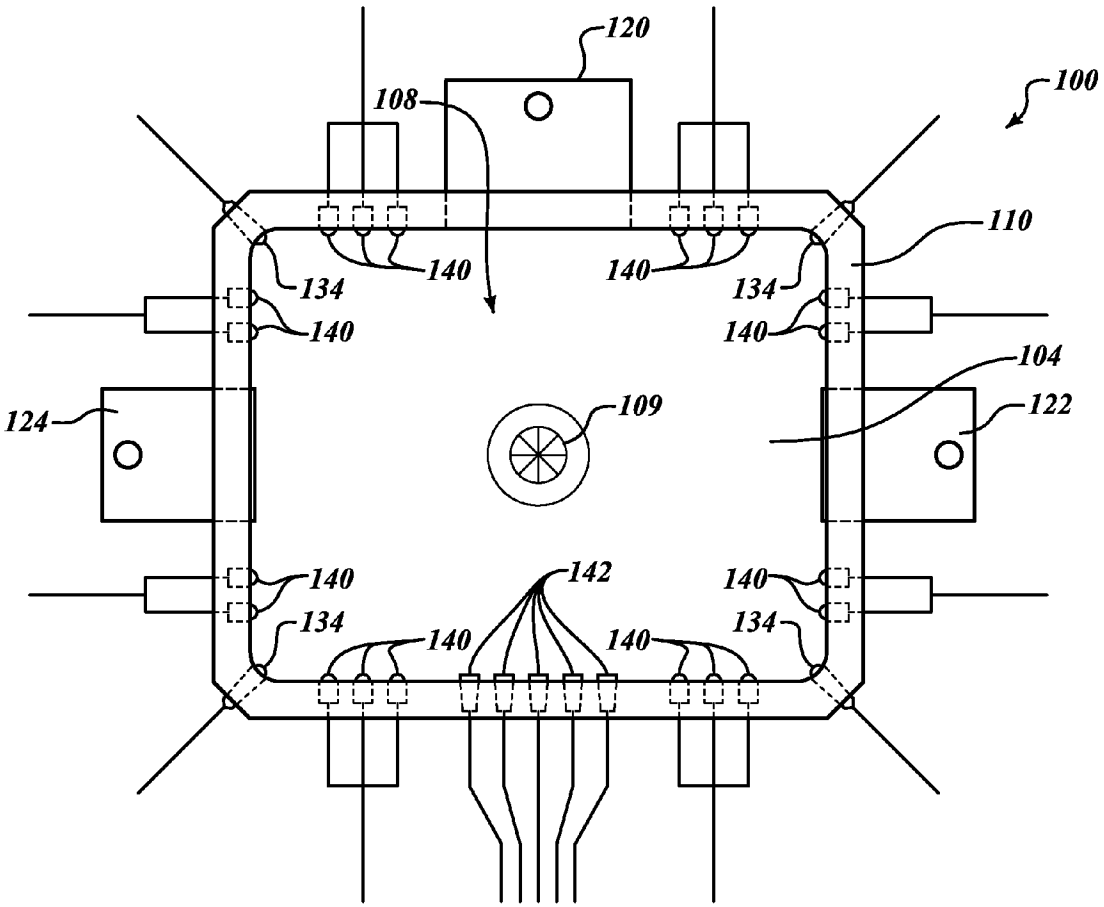
FIG. 7 is a top plan schematic diagram of the undermount sink system of FIG. 6.

The spacer ring 110 may further include a plurality of position sensors 134 mounted around a perimeter thereof, as best shown in the schematic diagram of FIG. 7. The position sensors 134 may be arranged, for example, in each of the four corners of a spacer ring 110 having a generally rectangular configuration. The position sensors 134 may be arranged to sense a position of a user's hand or an object in the user's hand within the internal region 108 of the sink basin 104 using, for example, triangulation principles. With this information, the sink system 100 may be configured to provide enhanced functions. For example, in some embodiments, the position of the user's hand may be used to determine which discharge conduits 120, 122, 124, if any, should be activated to produce a corresponding stream 126 of water. In addition, the temperature of the discharged water may be controlled in accordance with hand or object position. For instance, positioning one's hand(s) in front of a left side of the primary discharge conduit 120 may generate a relatively hot stream of water, whereas positioning one's hand(s) in front of a right side of the primary discharge conduit 120 may generate a relatively cold stream of water. Intermediate positions may feature intermediate temperatures and the temperature may increase incrementally or continuously as a user moves his or her hand(s) left-to-right or right-to-left in front of the discharge conduit 120. Still further, a flow rate or stream trajectory may be controlled based on the distance of one's hand(s) or an object from an outlet 136 (FIG. 6) of the primary discharge conduit 120. For instance, a water stream may be discharged at a relatively low rate and short trajectory when one's hands are relatively close to the outlet 136, and may be discharged at a higher rate and far trajectory when one's hands are relatively far from the outlet 136. Accordingly, in some embodiments, a user may place his or her hands or an object in the internal region 108 of the sink basin 104 and receive a stream of water generally sufficient to reach the same irrespective of a distance from the outlet 136.

The spacer ring 110 may further include a plurality of lighting elements mounted around a perimeter thereof, such as, for example, a plurality of LEDs 140, as shown in FIGS. 6 and 7. The LEDs 140 may be operated with a switch mounted directly to the spacer ring 110 or sink basin 104, or alternatively, a switch mounted remotely from the same. In some embodiments, the LEDs 140 may be communicatively coupled to a motion sensor (not shown) mounted within the room of the sink system 100 to detect the presence of someone in the room and selectively illuminate the internal region 108 of the sink basin 104 in response to the presence of an individual entering the room. Accordingly, the peripheral edge of the sink system 100 may advantageously illuminate when someone enters at night to assist the user in locating and using the sink system 100 under low-level lighting conditions without requiring the user to locate a light switch. Conversely, the LEDs 140 may be turned off when the individual leaves the room and is no longer sensed within the room.

The LEDs 140 may also be communicatively coupled to the position sensors 134 to illuminate in response to a position or motion of a user's hand or object within the interior region 108 of the sink basin 104. In this manner, the LEDs 140 may provide visual feedback to a user. For example, as described above, the temperature of water may vary as one moves an object or his or her hand from left-to-right or right-to-left within the interior region 108 of the sink basin 104. A series of LEDs 140 may be provided and configured to illuminate in sequence incrementally with increases in temperature or by changing color or other characteristics, thereby providing visual user feedback of the expected water temperature of the discharged water stream.

The spacer ring 110 may further include a plurality of switches, buttons or other control devices mounted therein to control various functions of the sink system 100. For example, as shown in FIG. 7, the spacer ring 110 may retain a plurality of micro switches 142 on a face thereof opposite where the spacer ring 110 houses the primary discharge conduit 120. The micro switches 142 may be used to turn the flow of water on or off and to control a flow rate and/or temperature of the discharged water. For instance, one of the micro switches 142 may be provided to turn the flow of water on and off, or enable and disable the flow of water in response to position and/or motion sensing within the interior region 108 of the sink basin 104. Other micro switches 142 may increase and decrease the temperature of discharged water or increase and decrease the rate of flow of the discharged water, for example.

Figure 8:
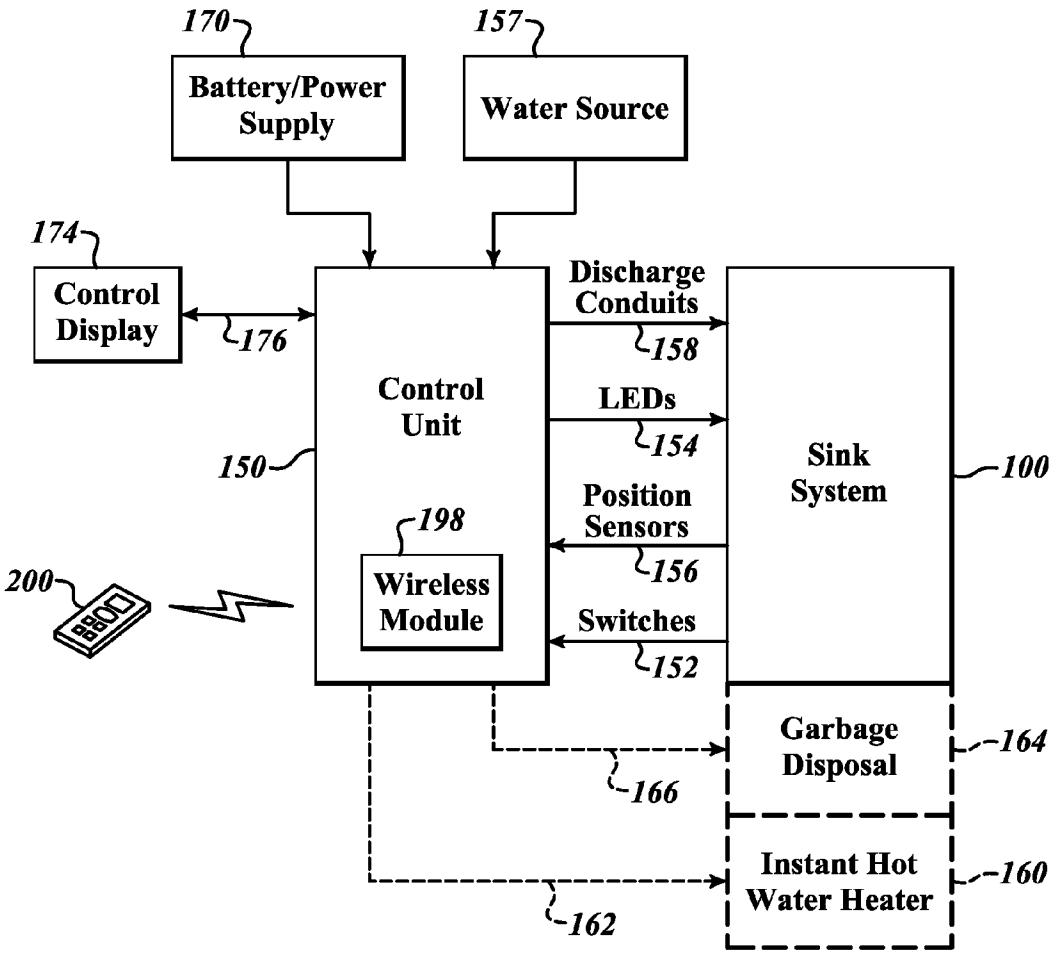
FIG. 8 a schematic diagram of an integrated sink system including the undermount sink system of FIG. 6.

With reference to FIG. 8, the micro switches 142 or other control devices may be communicatively coupled to a control unit 150, as represented by the arrow labeled 152. The micro switches 142 or other control devices may be coupled to the control unit 150, for example, by electrical conductors in the form of a ribbon cable and appropriate electrical connectors. The control unit 150 may similarly be communicatively coupled to the LEDs 140, as represented by the arrow labeled 154, to provide power to the same for selective illumination of the LEDs 140 in accordance with embodiments of the sink systems 100 described herein. Still further, the control unit 150 may be communicatively coupled to the position sensors 134, as represented by the arrow labeled 156, to receive position signals from the same for controlling various functions of the sink systems 100.

Moreover, the control unit 150 may also include various electronic flow and temperature control valves and a manifold containing the same to selectively route a supply of water form a water source 157 to each of the one or more discharge conduits 120, 122, 124 of the sink system 100, as represented by the arrow labeled 158. Alternatively, a separate manifold or manifolds and appropriate valves may be provided separate from the control unit 150, but nevertheless communicatively coupled to the same to receive valve control signals during operation. For example, during operation, the control unit 150 may receive control signals from the positional sensors 134 based at least in part on the position of an object within the interior region 108 of the sink basin 104 and cause a valve or valves to shift in response to the same to initiate the discharge of water and/or to change a temperature and/or a rate of discharged water. In some embodiments, the control system 150 will determine which, if any, of the discharged conduits 120, 122, 124 should be utilized based on the control signals received from the position sensors 134. In this manner, the control unit 150 and associated devices combine to create a "smart" sink system 100 with enhanced functions atypical of conventional sinks 10 (FIG. 1).

With continued reference to FIG. 8, the control unit 150 may also be communicatively coupled to various other ancillary features of the sink system 100 when provided. For instance, the sink system 100 may include a heater 160 to provide instant hot water near boiling which is communicatively coupled to the control unit 150 to receive control signals therefrom, as represented by the arrow labeled 162. As another example, the sink system 100 may include a garbage disposal 164 to breakdown debris passing through the drain 109 which is communicatively coupled to the control unit 150 to receive control signals therefrom, as represented by the arrow labeled 166. The control unit 150 may be powered by a battery or other power supply 170, such as, for example, mains power.

Figure 9:
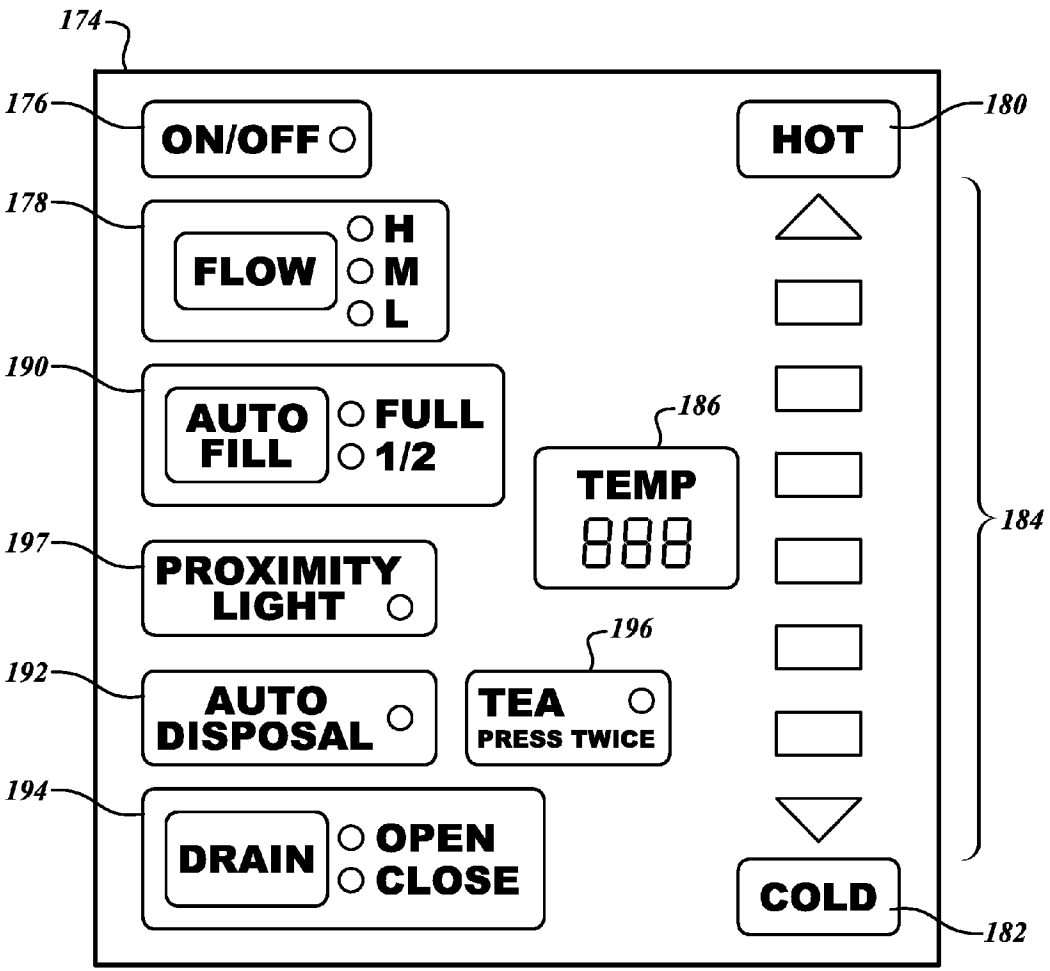
FIG. 9 is a control display, according to one embodiment, usable with the integrated sink system illustrated in FIG. 8.

A control display 174 may be provided to interface with the control unit 150 to transmit and receive various control signals in accordance with the sink functions described herein, as represented by the double headed arrow labeled 176. FIG. 9 shows, for example, one embodiment of a control display 174 which may be provided as a user interface for operating some or all of the functions of the corresponding sink system 100.

As shown in FIG. 9, the control display 174 may include an on/off control 176 with an LED indicator for turning the flow of water on and off or for enabling and disabling the flow of water in response to position and/or motion sensing within the interior region 108 of the sink basin 104. In addition, a flow control 178 may be provided to enable selection between high, medium and low flow conditions. Temperature controls 180, 182 may also be provided to enable temperature adjustment. A series of LEDs 184 and/or a digital temperature indicator 186 may be included to provide visual feedback of the temperature setting. Controls for initiating flow and adjusting temperature and flow rate are primary control features.

Ancillary or supplemental control features may also be provided in some embodiments. For example, an auto-fill control 190 may be provided which is configured to provide a signal to initiate an auto-fill function in which a determined volume of water is discharged into the sink basin 104. One, two or more determined fill volumes may be established. As another example, an auto disposal button 192 may be provided which is configured to provide a signal to initiate an auto disposal function in which a flow of water is discharged into the sink basin 104 while a garbage disposal 164 (FIG. 8) is activated for a relatively short duration. As yet another example, a drain control button 194 may be provided for initiating a valve to close a shutter of the drain 109 and enable the sink basin 104 to be filled with water for various culinary or other activities. Still further, an instant hot water control 196 or "tea" control may be provided to discharge water near boiling to prepare, for example, teas or other hot beverages. As a safety precaution, the instant hot water control 196 may require a user to press a touch button control twice or otherwise confirm that hot water is desired. In addition, the availability of instant hot water from the heater 160 (FIG. 8) may be coordinated with a motion sensor located within the kitchen or other room accommodating the sink system 100 or in some instances adjacent rooms thereof. More particularly, the heater 160 may remain idle until the presence of someone is detected in the room or the vicinity of the sink system 100 by the motion sensor. In this manner, energy is conserved by avoiding the need to continuously maintain a supply of heated water near boiling. Rather, the heater 160 may be activated to prepare a heated supply of water near boiling during those times when it is more likely that a user will require the same. In a similar manner, a home recirculation pump may remain idle until those times when it is expected that a user may seek to use hot water. As yet another example, a proximity light control 197 may be provided which is configured to activate and deactivate a proximity light feature wherein the sink basin 104 is selectively illuminated when the presence of an individual is sensed within the room or vicinity of the sink system 100.

As can be appreciated from the above, many convenient features may be integrated into the sink system 100 to provide a particularly handy or "smart" sink apparatus for residential and commercial applications. The control display 174 may enable a user to selectively control some or all of the features of the sink system 100 from a common interface. The control display may be mounted on the surface of the counter 102, a counter backsplash or any other convenient location near the sink basin 104.

Still further, as shown in FIG. 8, the control unit 150 may include a wireless communication module 198 to enable features of the sink system 100 to be remotely controlled using wireless communication technology, such as, for example, wireless Bluetooth technology. In this manner, the rate and/or temperature of flow discharged into the sink basin 104 may be selectively controlled by a handheld electronic device 200 (e.g., smart phone) thereby providing further operational versatility. A communication port, such as a USB port, may also be provided for diagnostic and other purposes.

According to some embodiments, the control unit 150 and control display 174 may be packaged with the sink basin 104, spacer ring 110 and one or more discharge conduits 120, 122, 124 as a sink installation kit. The one or more discharge conduits 120, 122, 124 may be preinstalled on the spacer ring 110 and the spacer ring 100 may be preassembled with the sink basin 104. In other embodiments, the spacer ring 110 and associated devices housed therein (e.g., discharge conduits 120, 122, 124, LEDs 140, etc.) may be packaged together as a kit to be installed with various conventional sink basins sold separately.

Although various functional aspects of the sink systems 20, 100 described herein have been discussed with reference to undermount sink systems and in particular undermount sink systems with discharge conduits located entirely below a countertop surface, it is appreciated that many aspects are suited for use with other sink systems, including sinks with traditional faucet arrangements. Still further, although many functional aspects have been described in connection with the sink systems 20, 100, one skilled in the relevant art will recognize that embodiments may be practiced without one or more of these functional aspects.

Moreover, the various embodiments described above can be combined to provide still further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An undermount sink system for mounting beneath a countertop having an upper counter surface, the undermount sink system comprising:

a basin, the basin having a drain hole at a lower end thereof; and a discharge conduit coupled to the basin and positioned to expel fluid into the basin via an outlet of the discharge conduit when a flow of fluid through the discharge conduit is activated, the discharge conduit and basin configured to mount to the countertop entirely below the upper counter surface.

2. The undermount sink system of claim 1, further comprising:

a spacer ring coupleable to an upper end of the basin to space the basin from the countertop when the basin is installed for use.

3. The undermount sink system of claim 1, further comprising:

a heater unit coupled to the discharge conduit via a fluid supply line, the heater unit operable to elevate the temperature of the flow of fluid through the discharge conduit near boiling when the flow of fluid is initially activated.

4. The undermount sink system of claim 1, further comprising:

a rotating head coupled to the outlet of the discharge conduit, the rotating head including a plurality of apertures having different configurations to enable selective variation of at least one of a shape and a direction of a stream of fluid expelled from the discharge conduit during operation.

5. The undermount sink system of claim 1, further comprising:

a sensor coupled to the basin to sense movement of a user and activate the flow of fluid through the discharge conduit based on said movement.

6. The undermount sink system of claim 1, further comprising:

a plurality of position sensors coupled to the basin to sense a hand position and regulate the flow of fluid through the discharge conduit based on said position.

7. The undermount sink system of claim 1, further comprising:

a valve coupled to the discharge conduit, the valve operable to control at least one of a rate and a temperature of the flow of fluid through the discharge conduit.

8. The undermount sink system of claim 7 wherein the valve is operable via a control device coupled directly to the wall of the basin.

9. The undermount sink system of claim 7 wherein the valve is operable via a control display device positioned remotely from the basin, the control display device including controls operable to control at least one of a rate and a temperature of the flow of fluid through the discharge conduit.

10. The undermount sink system of claim 7, further comprising:

a wireless communication device operatively coupled to the valve to enable remote control of the valve via a handheld device.

11. The undermount sink system of claim 1, further comprising:

a switch to selectively activate and deactivate the flow of fluid through the discharge conduit, the switch coupled to the wall of the basin.

12. The undermount sink system of claim 1, further comprising:

a thermostat operatively coupled to the discharge conduit to detect and regulate a temperature of the flow of fluid therethrough.

13. A sink system configured for installation on the underside of a countertop, the sink system comprising:

a sink basin;

a discharge conduit coupled to the sink basin and positioned to expel fluid into the sink basin via an outlet of the discharge conduit below an upper surface of the countertop when a flow of fluid through the discharge conduit is activated;

a valve coupled to the discharge conduit, the valve operable to control at least one of a rate and a temperature of the flow of fluid through the discharge conduit; and a control device communicatively coupled to the valve to selectively adjust the valve in response to one or more control signals generated by an interaction of a user with the sink system within an interior region of the sink basin.

14. The sink system of claim 13, further comprising:

a spacer ring coupleable to an upper end of the sink basin to space the sink basin from the countertop when the sink basin is mounted to the countertop, the spacer ring configured to receive the discharge conduit.

* * * * *